US006312342B1

(12) United States Patent
Newsome

(10) Patent No.: US 6,312,342 B1
(45) Date of Patent: Nov. 6, 2001

(54) BILLIARD RACK

(76) Inventor: Reginald W. Newsome, 216 Philray Rd., Richmond, VA (US) 23225

( * ) Notice: Subject to any disclaimer, the term of this patent is extended or adjusted under 35 U.S.C. 154(b) by 0 days.

(21) Appl. No.: 09/516,262

(22) Filed: Feb. 29, 2000

(51) Int. Cl.[7] ..... A63D 15/00
(52) U.S. Cl. ..... 473/40
(58) Field of Search ..... 473/40, 41, FOR 40, 473/FOR 41, 1–4; 206/315.1

(56) References Cited

U.S. PATENT DOCUMENTS

D. 159,558 * 8/1950 Sundell ..... 473/40
1,089,140 * 3/1914 Madigan ..... 473/40
2,126,006 * 8/1938 Gross ..... 473/4
3,253,826 * 5/1966 Cook ..... 473/40
3,992,005 * 11/1976 Richey ..... 473/40
4,469,328 * 9/1984 Pacitti ..... 473/40
5,531,646 * 7/1996 Boyle ..... 473/40
5,716,285 * 2/1998 Maceri ..... 473/40

* cited by examiner

*Primary Examiner*—Jeanette Chapman
*Assistant Examiner*—Mitra Aryanpour

(57) ABSTRACT

A pocket pool or billiard rack that incorporates in its rearmost side outwardly and angularly extending lever portions that permit upward rotation of the billiard rack upon the application of downward pressure with the thumbs or other fingers prior to removal of the billiard rack from about the balls in the ball racking operation. According to a preferred embodiment of the invention, cut outs or reliefs are provided in the interior walls of the billiard rack below the points of contact of the billiard rack with the balls to further facilitate the rotational removal of the billiard rack from about the balls.

5 Claims, 4 Drawing Sheets

BILLIARD RACK

FIELD OF THE INVENTION

The present invention relates to billiard racks for pool or billiard balls and more particularly to an improved such device that simplifies the racking operation while assuring a tight racking of the balls.

BACKGROUND OF THE INVENTION

In the racking of pocket pool or billiard balls prior to the initiation of play, the balls are placed in a triangular rack, the head ball located on the appropriate spot, the balls forced toward the front of the rack with the fingers (generally the thumbs) and the rack vertically removed from about the balls. During the removal of the rack from about the balls, it is not uncommon that one or more portions of the rack contacts the balls causing the rack to "loosen". The occurrence of such a condition requires that the balls be "reracked" until a tight i.e. all balls touching, rack is achieved.

The design of a rack that permits even the most inexperienced player to properly rack the balls without the possibility of "loosening" the rack in the process of removal of the billiard rack would be of significant benefit to the pool and billiard playing community.

OBJECTS OF THE INVENTION

It is therefore an object of the present invention to provide a pocket pool or billiard ball-billiard rack that allows even the most inexperienced player to properly rack the balls before the onset of play.

It is another object of the resent invention to provide a ball-billiard rack that rotates out or contact with the balls during the racking operation rather than requiring vertical removal of the rack from about the balls.

SUMMARY OF THE INVENTION

According to the present invention there is provided a generally triangular billiard rack that incorporates in its rearmost side at least one outwardly and angularly extending lever portion that permits upward rotation of the billiard rack from contact with the balls upon the application of downward pressure with the thumbs or other fingers prior to removal of the billiard rack from about the balls in the ball racking operation. According to various preferred embodiments of the invention, a pair of lever portions are incorporated in the rearmost side, cut outs are provided in the interior walls of the billiard rack below the points of contact of the billiard rack with the balls to further facilitate the rotational removal of the billiard rack from about the balls and the lower portions of walls are cut away to further facilitate removal of the rack from about the balls.

DETAILED DESCRIPTION

The billiard rack of the present invention through the incorporation of outwardly extending angular lever portions in its rearmost side permits upward rotational removal thereof from about the periphery of pocket pool or billiard balls located therein for racking and location on the playing surface. This design permits even the most inexperienced player to properly rack the balls without accidentally striking one or more of the balls during vertical removal of the billiard rack from about the balls in the racking operation.

In the conventional racking operation, the balls are placed within the confines of the billiard rack, tightened against the front apex thereof by pressure with the fingers or thumbs against the rearmost balls, properly located on the playing surface, the rack moved backwards slightly to permit disengagement with the balls and the rack then lifted vertically from about the balls. The billiard rack of the present invention eliminates the vertical lifting of the rack and substitutes therefor a rotational removal of the rack from about the balls.

Figure 1:
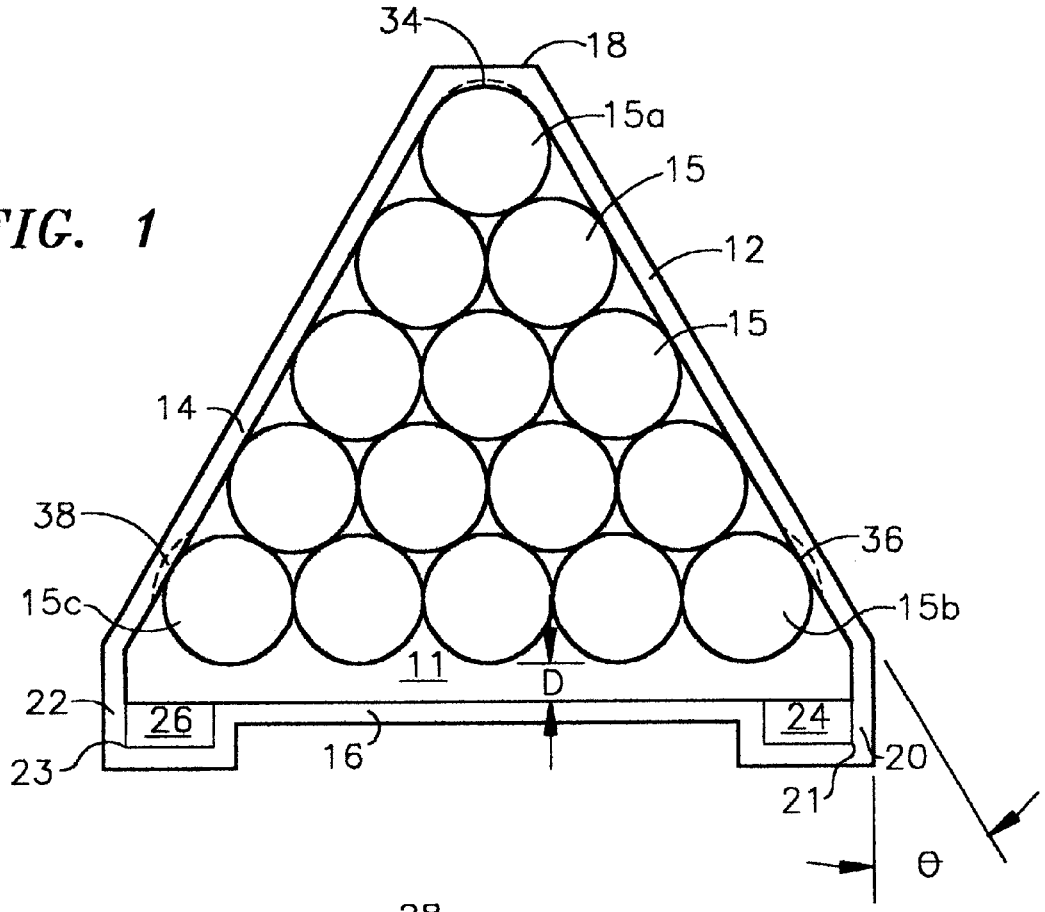
FIG. 1 is a partially phantom top plan view of the billiard rack of the present invention oriented about the pool balls after the balls have been tightened in the billiard rack
Figure 5:
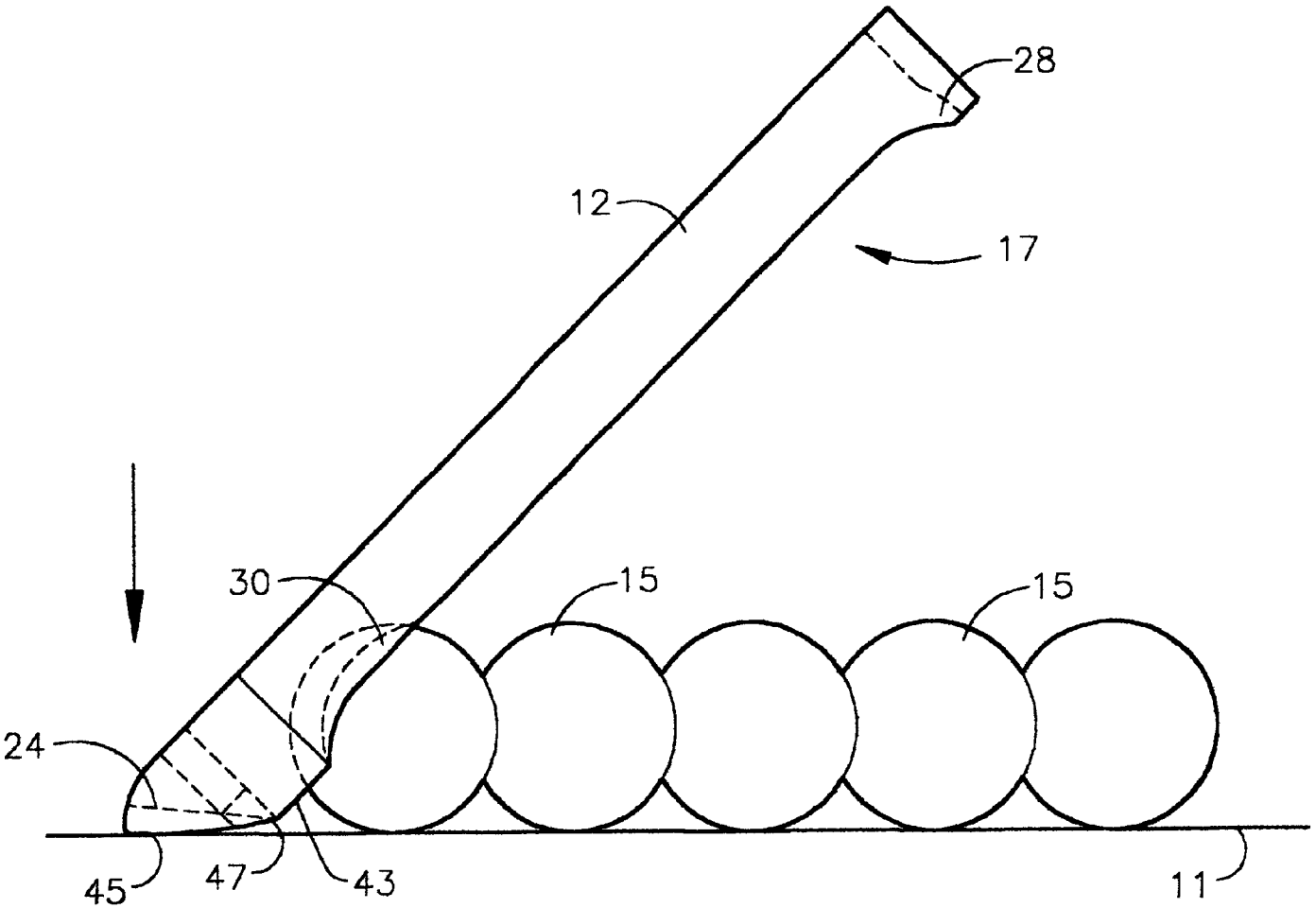
FIG. 5 is a partially phantom side view of the billiard rack of the present invention in the rotated position preparatory to removal from the racking position.

Referring now to FIG. 1 that depicts the condition where the balls have been tightened against the front apex of the billiard rack, the billiard rack 10 of the present invention is generally triangularly shaped having two front sides 12 and 14 and a rear side 16 that contain balls 15 in the racking operation. This triangular shape is substantially the same as that of prior art such devices. However, front sides 12 and 14 and rear side 16 are preferably slightly longer than those of a conventional billiard rack since front sides 12 and 14 have angularly extending extremities 20 and 22 resulting in distance d (the distance between the tightened balls and rear side 16) being preferably about ¾" rather than ¼" as is typically the case. The apex 18 of device 10 comprises the forwardmost portion of billiard rack 10 and the junction of front sides 12 and 14. According to the embodiment depicted in FIG. 1, rear side 16 incorporates at its opposing extremities that form the junctions 21 and 23 of front sides 12 and 14 with rear side 16, outwardly and angularly extending lever portions 24 and 26 that permit engagement with the fingers or thumbs. Upon the application of downward pressure on lever portions 24 and 26, upward rotational removal of billiard rack 10 from about balls 15 as shown in FIG. 5 and described in greater detail hereinafter is obtained. It should be noted that a single partial or full width lever portion or multiple, i.e. greater than two such lever portions, may also be incorporated into rear side 16 to produce equivalent functional results. Such modifications are clearly anticipated as being within the scope of the instant invention.

Figure 2:
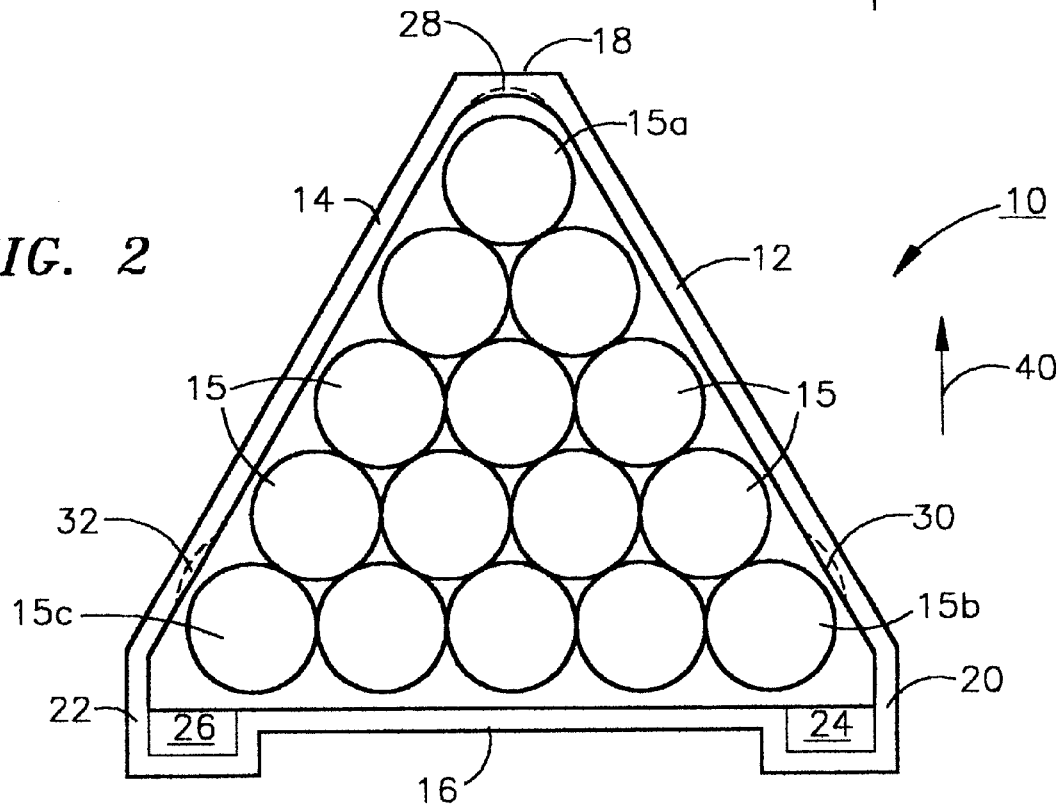
FIG. 2 is a partially phantom top plan view of the billiard rack of the present invention oriented about the pool balls just prior to removal of the rack from about the balls.

As is readily discerned from FIGS. 1 and 2, in the embodiment depicted in these Figures, front sides 12 and 14 and rear side 16, although defining a containment triangle for balls 15, do not themselves literally form a triangle since extremities 20 and 22 of front sides 12 and 14 turn inward at an angle θ of 30° prior to their intersection or meeting with rear side 16. In the embodiment depicted in these Figures, the points of intersection 21 and 23 are the edges of lever portions 24 and 26. According to alternative embodiments not represented in the drawings, lever portions 24 and 26 could be located closer to the center of rear side 16, and, accordingly, intersections 21 and 23 would occur with vertical portions of rear side 16 forming square right angles rather than the angularly displaced angles depicted in the drawing.

The angle of lever portions 24 and 26 is not of particular importance to the successful practice of the present invention so long as proper upward rotation of billiard rack 10 as described herein is achieved. An angle of about 50° has, however, been found to provide an optimum result.

Figure 4:
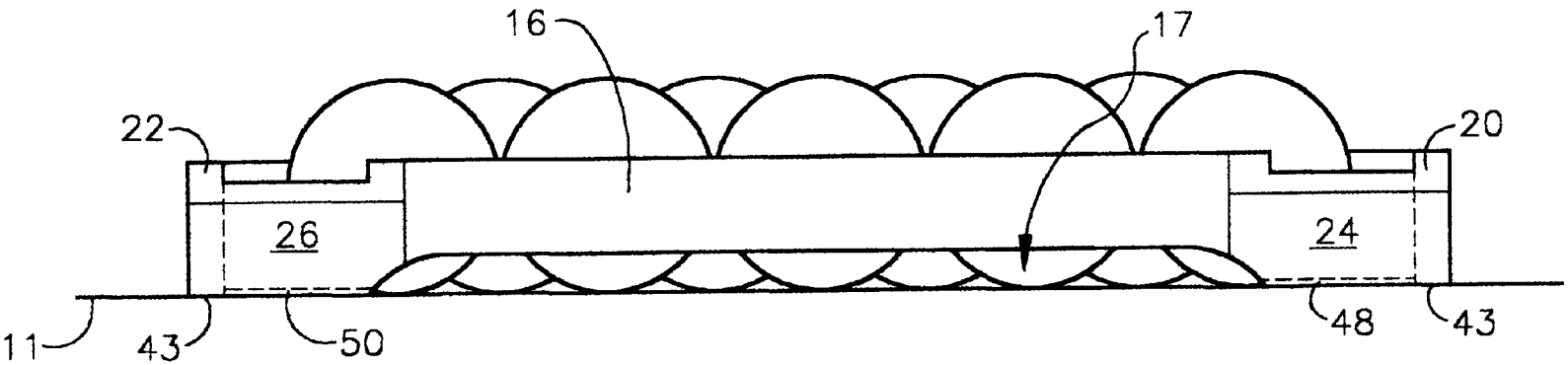
FIG. 4 is a rear view of the billiard rack of the present invention.

Referring now to FIG. 2 that depicts the situation where the balls have been properly located on playing surface 11 and billiard rack 10 pushed forward slightly in the direction of arrow 40 to allow disengagement of front sides 12 and 14 and apex 18 from about balls 15, the advantage of the preferably slightly "oversized" dimensions of the preferred embodiment of billiard rack 10 can be observed. The additional space provided by the oversized condition permits easier, non-contacting removal of billiard rack 10. In the condition depicted in FIG. 2, removal of billiard rack 10 is achieved by simply applying pressure with the thumbs or fingers to lever portions 24 and 26 causing billiard rack 10 to rotate upwards out of proximity with balls 15 as shown in FIG. 5. As shown in FIG. 4, bottom surfaces 43 of lever portions 24 and 26 may incorporate reliefs or cutouts 48 and 50 to minimize the area of contact between bottom surfaces 44 and 46 and playing surface 11. This makes rotation of billiard rack 10 about pivot point 47 as shown in FIG. 5 easier, i.e. requiring the application of less pressure to achieve rotation.

Figure 3:
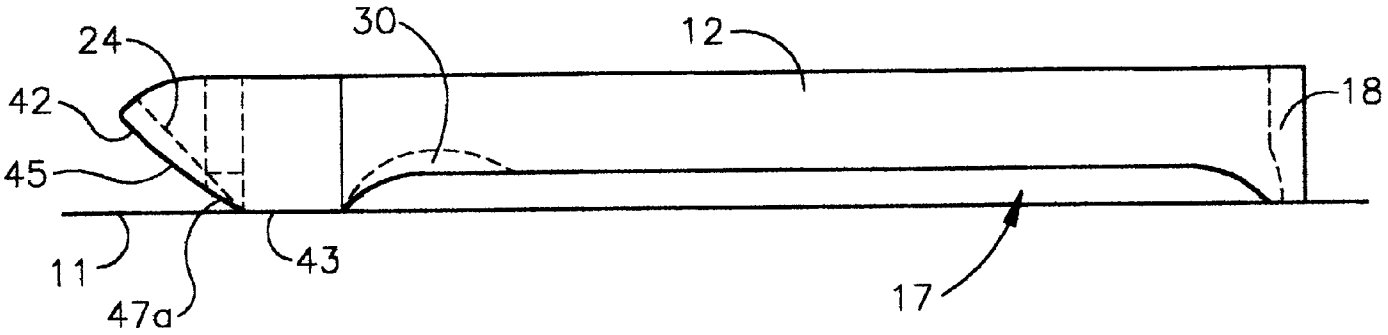
FIG. 3 is a partially phantom side view of the billiard rack of the present invention.

Referring now to FIG. 3 that depicts a right side view of billiard rack 10, and FIG. 4 that depicts a rear view of billiard rack 10, the preferred configuration of front sides 12 and 14 (front side 14 being a mirror image of front side 12) and rear side 16 and lower surface 42 of rear side 16 are best observed. As shown in FIGS. 3 and 4 front sides 12 and 14 and rear side 16 preferably incorporate a cutout 17. Cutouts 17 are provided by the simple removal of about the bottom one third of front sides 12 and 14 between apex 18 and extremities 20 and 22 and that portion of rear side 16 that does not include lever portions 24 and 26. From a manufacturing standpoint, cutouts 17 reduce the amount of material required in billiard rack 10. From a functional standpoint, cutout 17 minimizes the potential for contact of front sides 12 and 14 and rear side 16 with balls 15 during the rack removal process.

The shape of lower surface 42 may be varied widely to achieve the functional result described herein. For example the shape of lower surface 42 depicted in FIG. 5 that provides a rapid transition between two flat surfaces at the bottom 43 and rear lower surface 45 provides one such configuration. In the alternative configuration depicted in FIG. 3 a radiused transition 47*a* is provided between bottom 43 and relatively flat rear lower surface 45. While either of these configurations is operative, the radiused configuration depicted in FIG. 3 is preferred as providing a smoother transition in the rotating process.

Figure 6:
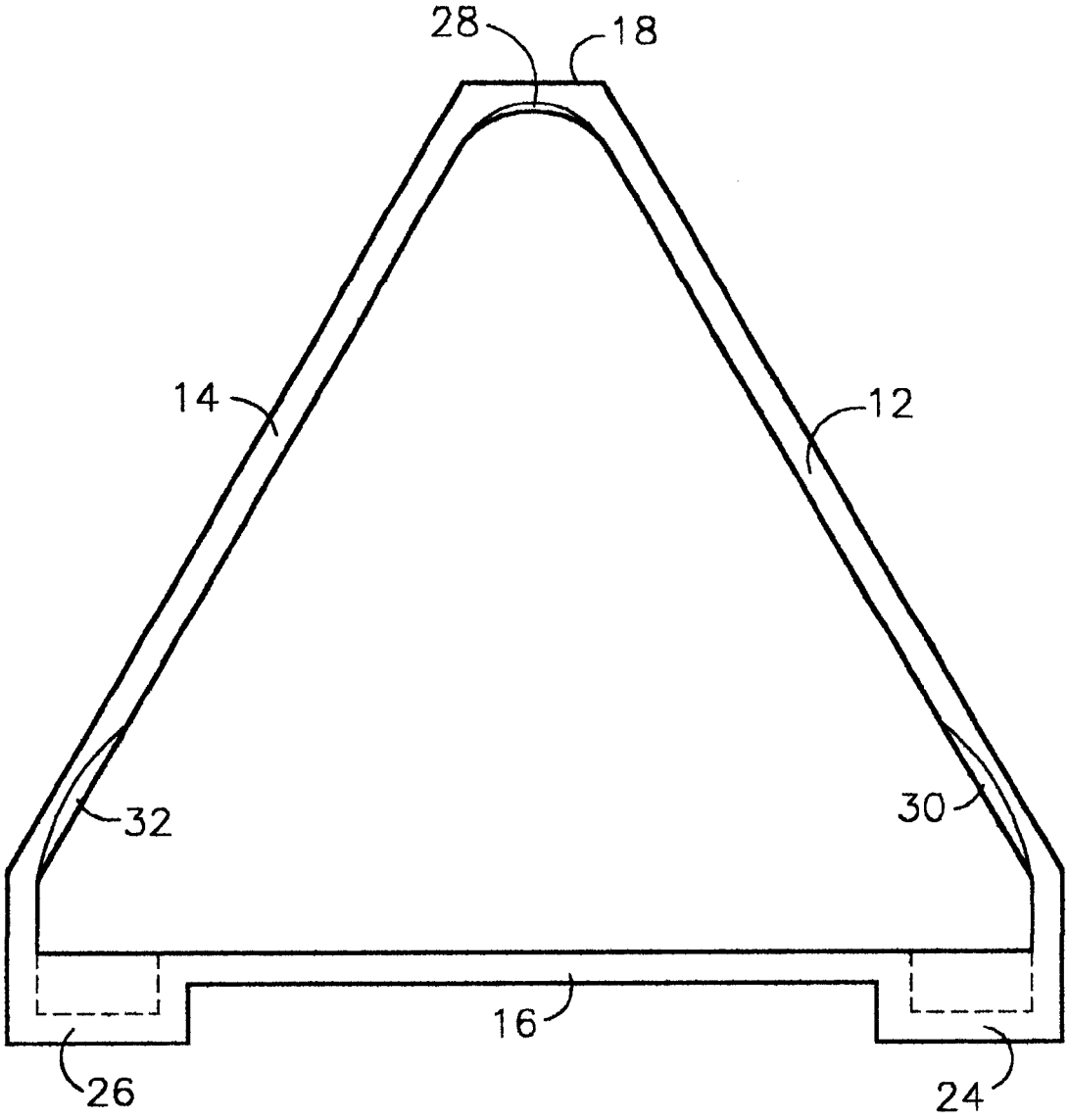
FIG. 6 is a bottom plan view of the billiard rack of the present invention.

According to another preferred embodiment best shown in FIG. 6, arcuate cutouts or reliefs 28, 30 and 32 are provided in apex 18 and front sides 12 and 14 below the points of contact 34,36 and 38 where balls 15*a*, 15*b* and 15*c* contact apex 18 and front sides 12 and 14. The utility of cutouts or reliefs 28, 30 and 32 will be described more fully in connection with the rotational operation of billiard rack 10 hereinafter. Cutouts or reliefs 28, 30 and 32 are shown in phantom in FIGS. 1, 2, 3, and 5 and are produced by removal of about one half of the thickness of the material in apex 18 and front sides 12 and 14 in the areas of reliefs 28, 30 and 32 that lie just below contact points 34, 36 and 38.

As shown most clearly by a comparison of FIGS. 1 and 2, in use or operation, balls 15 are first placed into billiard rack 10 and tightened as shown in FIG. 1 and appropriately located at the proper spot on the playing surface 11. In this configuration, balls 15*a*, 15*b* and 15*c* come into contact with contact points 34, 36 and 38. Billiard rack 10 is then slid forward in the direction of arrows 40 to disengage balls 15 with any contact with front sides 12 and 14 while not permitting contact with rear side 16. Downward pressure is then applied with the thumbs or fingers to lever portions 24 and 26 causing billiard rack 10 to rotate upward about pivot point 47 as shown in FIG. 5. Billiard rack 10 is then slid rearward away from the racked balls 15 or simply picked up as it rotates into the hands. Upon rotation by downward pressure on portions 24 and 26, as shown in FIG. 5 the incorporation of preferred cutouts or reliefs 28, 30 and 32 and cutouts 17 minimizes the possibility of accidental contact of apex 18 or front walls 12 and 14 of billiard rack 10 with balls 15*a*, 15*b* and 15*c* during the upward rotation and subsequent removal of billiard rack 10.

As the invention has been described, it will be apparent to those skilled in the art that the same may be varied in many ways without departing from the spirit and scope of the invention. Any and all such modifications are intended to be included within the scope of the appended claims.

What is claimed is:

1. A billiard rack defining a triangular ball containment area and comprising:

A) a pair of front sides that meet at an apex and have extremities away from said apex, that extend at an angle of 30° toward;

B) a rear side having left and right extremities joining said front sides at said front side extremities; and C) lever portions in said rear side which impart upward rotational movement to said billiard rack when downward pressure is applied thereto, and wherein, said front side extremities and said rear side have lower surfaces that define pivot points where said front side extremities and said rear side extremities join and said lever portions extends upwardly, outwardly and angularly from said rear side lower surface at or near the points where said rear side extremities and said front side extremities join.

2. The billiard rack of claim 1 further including cutouts along said lower surfaces of said front and rear sides.

3. The billiard rack of claim 2 wherein said cutouts comprise about one third of the height of said front and rear sides.

4. The billiard rack of claim 1 having contact points at said apex and on the interior of said front sides defined by the location of balls at the apexes of the triangle formed by contained balls that contact these points during tightening of the rack and further including reliefs in said apex and said front sides below said contact points.

5. The billiard rack of claim 4 wherein said reliefs comprise areas where said apex and said front sides are about one half of the thickness of said apex and said front sides.

* * * * *